United States Patent [19]

Lamphier et al.

[11] 4,451,172

[45] May 29, 1984

[54] OPEN TOP DRAIN

[75] Inventors: Larry N. Lamphier, Hubbard, Ohio; Walter A. Meyers, Bel Air, Md.

[73] Assignee: Bethlehem Steel Corp., Bethlehem, Pa.

[21] Appl. No.: 356,707

[22] Filed: Mar. 10, 1982

Related U.S. Application Data

[63] Continuation of Ser. No. 200,167, Oct. 10, 1980, abandoned, and Ser. No. 968,949, Dec. 13, 1978, abandoned.

[51] Int. Cl.[3] ..... E01F 5/00; E02B 11/00

[52] U.S. Cl. ..... 405/49; 404/4; 405/124; 405/126

[58] Field of Search ..... 405/36, 43, 47, 48, 405/49, 124, 126; 210/163, 164; 404/2, 3, 4

[56] References Cited

U.S. PATENT DOCUMENTS

| | | | |
|---|---|---|---|
| 59,804 | 11/1866 | Whitehead . | |
| 955,847 | 4/1910 | Carmean | 405/49 |
| 1,049,542 | 1/1913 | Smith | 405/49 X |
| 1,362,952 | 12/1920 | McQuery . | |
| 1,759,330 | 5/1930 | Van Horne | 405/49 |
| 3,225,545 | 12/1965 | Flegel | 404/2 X |
| 3,299,785 | 1/1967 | James | 404/4 |
| 3,374,634 | 3/1968 | Fochler | 405/49 |
| 3,465,654 | 9/1969 | Fox | 404/4 |
| 3,714,786 | 2/1973 | Evans et al. | 405/49 |
| 3,815,213 | 6/1974 | Evans et al. . | |
| 3,876,322 | 4/1975 | Deason | 404/2 |
| 3,882,743 | 5/1975 | Evans et al. . | |

FOREIGN PATENT DOCUMENTS

| | | | |
|---|---|---|---|
| 533712 | 12/1954 | Belgium | 404/2 |

*Primary Examiner*—David H. Corbin

*Attorney, Agent, or Firm*—John I. Iverson

[57] ABSTRACT

A corrugated metal open top pipe drain for the collection and removal of surface water from paved areas, such as highways, parking lots, airports and the like.

1 Claim, 9 Drawing Figures

FIG. 1
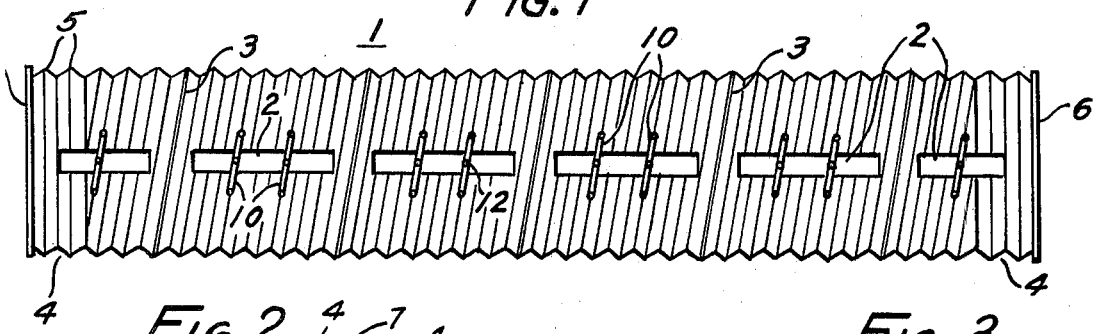
FIG. 2
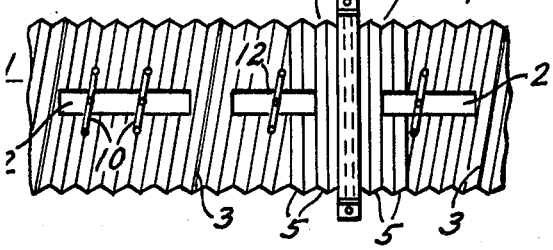
FIG. 3
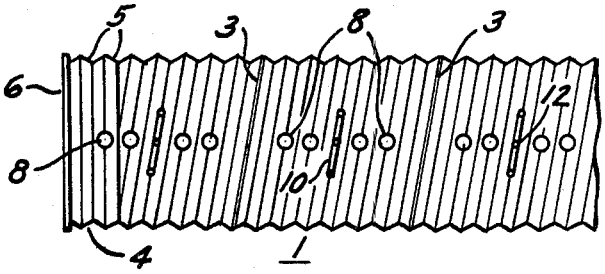
FIG. 4
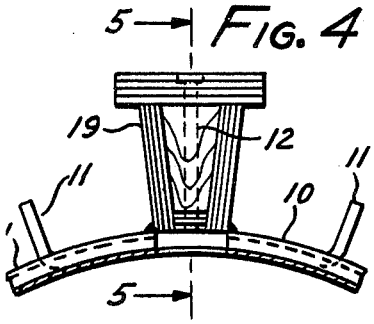
FIG. 5
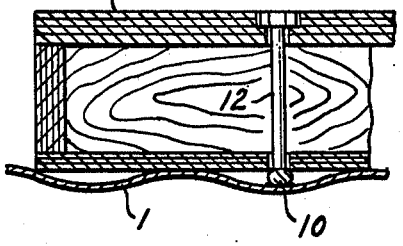
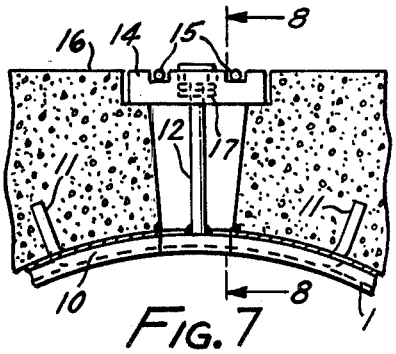
FIG. 7
FIG. 9
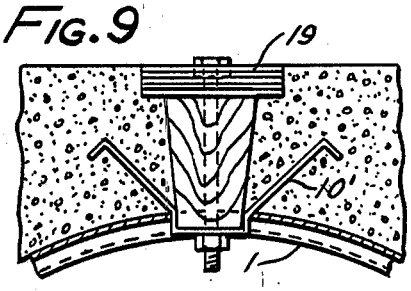
FIG. 6
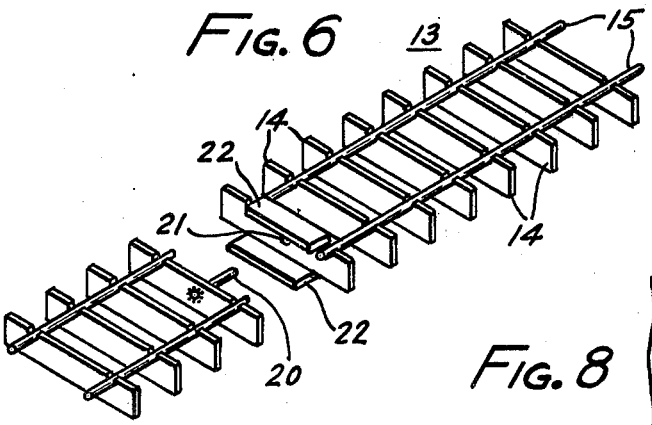
FIG. 8
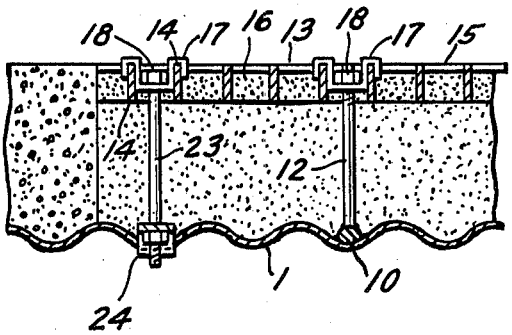

OPEN TOP DRAIN

This is a continuation of application Ser. No. 968,949, filed Dec. 13, 1978, now abandoned, and Ser. No. 200,167, filed Oct. 10, 1980, now abandoned.

BACKGROUND OF THE INVENTION

This invention relates to drainage culverts or pipes and relates particularly to a corrugated metal open top drain pipe used for the collection and removal of surface water from paved areas, such as highways, parking lots, airports and the like.

Surface water is normally removed from paved areas by constructing the pavement with an appropriate pitch and installing a network of curbs, gutters or other barriers and spaced catch basins. In recent years highway engineers have become concerned with the adequacy of such conventional surface water drainage arrangements since it has been discovered that high speed vehicle handling can be seriously impaired if the vehicle's tires are caused to hydroplane due to a water film on the surface of the pavement. A number of serious accidents have occurred as a result of the highway drainage systems' inability to quickly and adequately remove surface water during a heavy rain storm. In addition, some of the drainage structures, such as curbs and catch basins, are themselves hazardous to any vehicle coming in contact with them.

On large paved areas, such as parking lots or airport aprons, it is impractical to use curbs, gutters or sufficient catch basins to service the large volumes of surface water and therefore ponding of the surface water often occurs, which in cold climates can result in an ice hazard.

Open top culverts have been used in the past and are the subject of U.S. Pat. Nos. 1,362,952 and 1,444,198 to McQueary and U.S. Pat. No. 3,714,786 to Evans et al. Such previous open top culverts have either had structural deficiencies that prevented them from performing well over an extended period of time or were expensive to fabricate and install.

SUMMARY OF THE INVENTION

It is an object of this invention to provide an open top drain which will quickly and adequately remove large quantities of surface water from a paved area.

It is a further object of this invention to provide an open top drain which when installed does not present a hazard to vehicles.

It is another object of this invention to provide an open top drain which is economical to manufacture and install and will perform satisfactorily over an extended period of time.

It is a still further object of this invention to provide an open top drain which is versatile and easily adaptable to a variety of locations where surface water drainage is required.

It has been discovered that the foregoing objectives can be attained by providing a corrugated cylindrical culvert having a plurality of longitudinal spaced apart openings for the entry of water on the upper side of the culvert.

BRIEF DESCRIPTION OF DRAWINGS

FIG. 1 is a top view of a length of the preferred embodiment of the open top drain of this invention.

FIG. 2 is a partial top view of two lengths of the open top drain of this invention whose abutting ends are joined by a preferred coupling band.

FIG. 3 is a partial top view of a length of another embodiment of the open top drain of this invention.

FIG. 4 is a partial sectional view of open top drain of this invention.

FIG. 5 is a sectional view taken along lines 5—5 of FIG. 4.

FIG. 6 is an isometric view of the grating used with the open top drain of this invention.

FIG. 7 is a partial sectional view of the open top drain of this inventoion installed in a pavement.

FIG. 8 is a sectional view taken along the lines 8—8 of FIG. 7.

FIG. 9 is a partial sectional view of a modification of the open top drain of this invention.

DESCRIPTION OF THE PREFERRED EMBODIMENT

Referring to FIGS. 1 and 2, the preferred embodiment of this invention comprises a corrugated helical lock seam pipe 1 having a plurality of longitudinally spaced openings 2 formed in the upper side of the pipe 1.

Corrugated helical pipes or culverts are well known and are made from a continuous strip of metal, such as steel, which is first corrugated and then helically bent to form a cylinder with the opposing edges of the steel strip joined together by a lock seam 3 or by welding. While we prefer to use a corrugated helical lock seam pipe 1 for our invention, annularly corrugated or even smooth walled cylindrical pipe could be used for our invention also, if desired.

As best illustrated in FIG. 2 we prefer to reform the ends 4 of the pipe 1 to form several annular corrugations 5 and a flange 6, as described in U.S. Pat. No. 4,079,614 to Hall, to enable the pipes 1 to be connected end to end with a channel shaped coupling ring 7.

If desired, it would not be necessary to reform the ends of the pipe 1 as described above in which case any of the well known conventional annular connecting bands which engage the corrugations could be used to connect the ends 4 of the pipes 1 together.

The openings 2 formed in the upper side of the pipe 1 of this invention extend along the longitudinal axis of pipe 1 at regular repeating intervals and are preferably a plurality of longitudinally spaced, longitudinally elongated rectangular slots, as best shown in FIGS. 1 and 2. The ends of the slot-like openings 2 terminate short of lock seam 3 or weld.

In FIG. 3, we illustrate another embodiment of this invention where the longitudinally spaced openings 2 are a line of punched round perforations 8 in adjacent valleys of the corrugations of pipe 1.

As contrasted with previous open top drains, the longitudinal openings 2 are not continuous but are disposed at regular repeating intervals. Sufficient metal remains between the openings 2 to preserve the structural integrity of the pipe 1.

As best illustrated in FIGS. 1 and 4, a series of crossbars 10 having upwardly and outwardly bent ends 11 are positioned across the openings 2 in the valleys of the corrugations and welded to the outer surface of the pipe 1.

FIG. 9 illustrates an alternate form of crossbar 10′ formed from a flat rather than a round bar and welded to the outer surface of pipe 1 across the opening 2.

A threaded stud 12 is welded to the center of each crossbar 10 in a vertical position. Stud 10 serves to position and retain a metal grate member 13 illustrated in FIG. 6 directly above the openings 2 as best shown in FIGS. 7 and 8.

The metal grate member 13 can be of various shapes and forms but should be sufficiently strong to support vehicle loads. We prefer to fabricate the grate member 13 in a rectangular shape as shown in FIG. 6 using a plurality of parallel flat bearing bars 14 set on edge which are spaced and fastened together by a pair of round spacer bars 15.

As shown in FIG. 6, a pin 20 is welded to the end bearing bar 14 of one grate member 13 to engage a mating opening 21 in the end bearing bar 14 of the adjacent grate member which when engaged and supported by horizontal support bars 22 prevent the ends of the gate members 13 from deflecting under vehicle loads.

FIGS. 7 and 8 illustrate the open top drainage pipe 1 of this invention placed in a typical concrete pavement 16. As shown in these FIGS. 7 and 8, the top surface of grate member 13 is positioned flush with the surface of pavement 16 and is held in place on stud 12 with a hold-down clip 17 and a nut 18. At the ends, a long bolt 23 and a bottom retention clip 24 which is locked in the opening 2 by nut 24 can be used to retain and support the end of grate 13. These fastening arrangements permit the quick and easy removal of the grate member 13 for cleaning, maintenance and repairs.

FIGS. 4, 5 and 9 illustrate an expendable wooden or plastic form 19 used to protect the drainage pipe 1 of this invention during installation and to assist in the placing of the concrete pavement 16 around the pipe 1. As shown in FIG. 4, the form 19 is trapdezoidal in shape with its bottom approximately the width of the openings 2 in pipe 1 and the top approximately the width of grate member 13.

Form 19 is temporarily held in place during the intallation of the pipe by a nut 18 attached to stud 12. The bottom of form 19 is sealed around openings 2 by notching the bottom of the form to conform to the shape of the corrugation or by the use of an elastomeric caulking material, to prevent leakage of wet concrete into the pipe 1. When the concrete pavement 16 has cured, form 19 is removed and discarded and grate member 13 is put into place and secured to stud 12 by hold-down clip 17 and nut 18 as previously described. Form 19 assures the proper opening in the concrete pavement 16 for the grating member 13 and further insures the proper vertical spacing of the grate member 13 relative to the openings 2 in pipe 1.

The upwardly and outwardly bent ends 11 of the cross bars 10 become imbedded in the concrete pavement 16 during its pouring and serve to anchor the pipe 1 to the pavement and prevent any rotational or other movement of the pipe 1 when in use.

An shown in FIG. 1, the pipe 1 of this invention has the openings 2 on the uppermost side to permit the entry of surface water into the pipe 1 with the rest of the pipe free of perforations. In some cases where the open top pipe drain of this invention will be used in locations having a high ground water table, it will be useful and desirable to also have perforations in the lower sides and bottom of the pipe 1 to permit the inflow of the ground water and to prevent any tendency of the pipe 1 to float out of the ground.

We claim:

1. A culvert having a corrugated metal cylindrical wall, said wall having seams parallel to the corrugations and having a plurality of longitudinally spaced apart longitudinally elongated rectangular openings disposed at regular repeating intervals in a line along the top of said culvert for the entry of water, said openings being separated longitudinally from each other by curved portions of said corrugated metal cylindrical wall, each separating curved wall portion including at least one corrugation and a seam, the bottom and sides of said culvert wall being essentially free of openings, and a plurality of metal bar anchor members, each anchor member having a curved portion extending obliquely across one of said openings and secured to the bottom of a corrugation valley on either side of said opening and having two end portions projecting upwardly and outwardly away from the outer surface of the wall of said culvert.

* * * * *